United States Patent [19]

Clifford et al.

[11] 4,455,931

[45] Jun. 26, 1984

[54] APPARATUS AND METHOD FOR PROCESSING RAW FIBER STOCK

[75] Inventors: Graham F. Clifford, Stanley, N.C.; Mack W. Spurrier, Clover, S.C.

[73] Assignee: Gaston County Dyeing Machine Company, Stanley, N.C.

[21] Appl. No.: 431,790

[22] Filed: Sep. 30, 1982

[51] Int. Cl.[3] ..... B30B 9/06

[52] U.S. Cl. ..... 100/37; 68/241; 100/73; 100/107; 100/127

[58] Field of Search ..... 100/37, 73, 107, 116, 100/126, 127; 8/156; 68/21, 241

[56] References Cited

U.S. PATENT DOCUMENTS

| | | | |
|---|---|---|---|
| 370,203 | 9/1887 | McBride | 68/241 X |
| 2,538,403 | 1/1951 | Watson | 100/127 X |
| 2,641,122 | 6/1953 | Cavagnaro, Jr. et al. | 68/241 |
| 3,460,363 | 8/1969 | Grantham | 68/241 |

*Primary Examiner*—Philip R. Coe

*Attorney, Agent, or Firm*—Richards, Shefte & Pinckney

[57] ABSTRACT

Apparatus and method for compressing raw fiber stock into a perforated basket for dyeing in a radial-flow dyeing machine. A hollow container is provided by a perforated cylinder section stacked separably on an imperforate section for loading fiber stock into the common interior. A piston movable under force of water pressure is located in the imperforate section to compress the loaded fiber stack into the perforated section. A closure plate is movable with the piston and is attachable to the perforated section following fiber compression to close the perforate section with compressed fiber therewithin, such that the perforated housing may be removed and used as a dyeing basket. A central core element is secured to the closure plate and is movable therewith to maintain an open center in the dyeing basket for use of the basket in a radial dyeing machine.

32 Claims, 17 Drawing Figures

Fig. 1
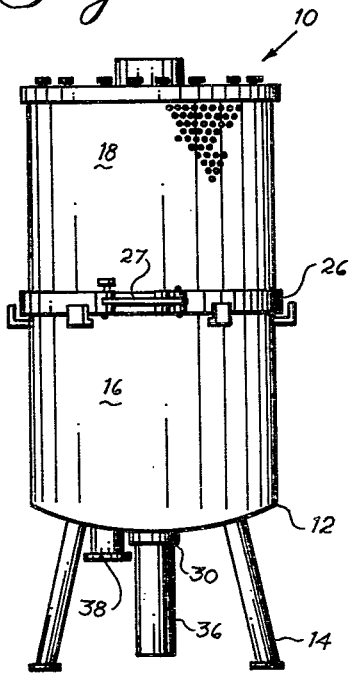
Fig. 2
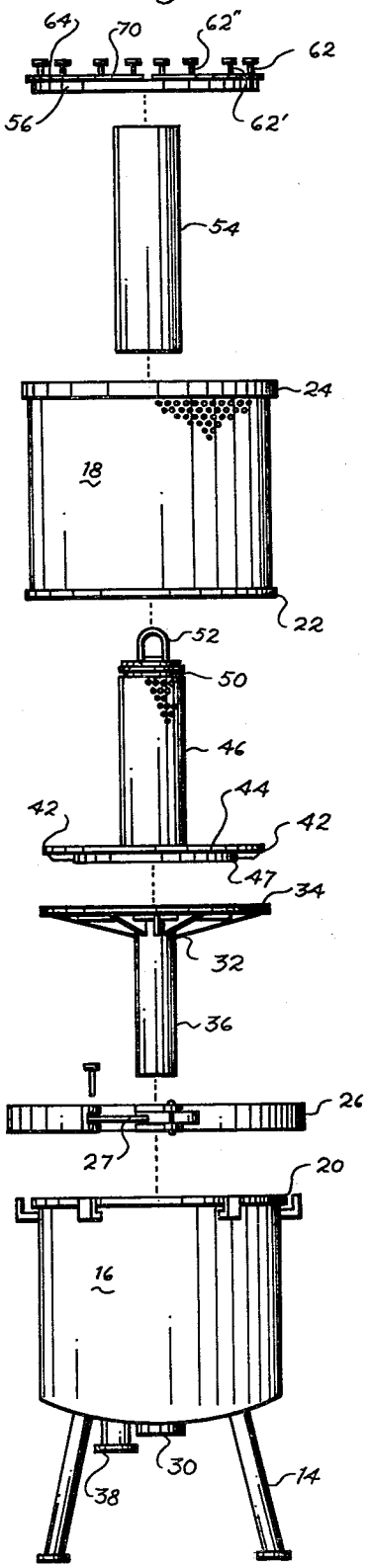
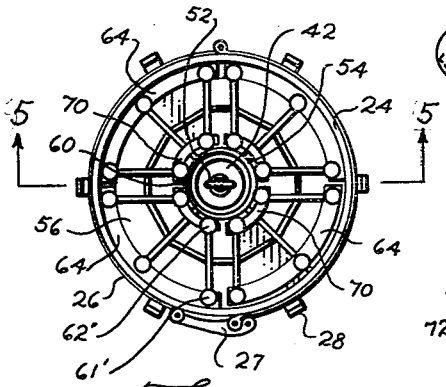
Fig. 3
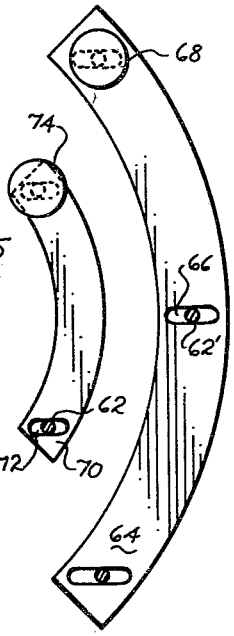
Fig. 3A
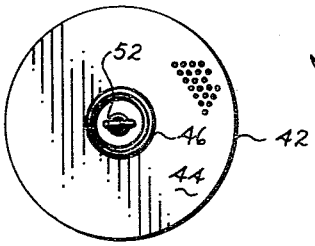
Fig. 4

Fig. 5
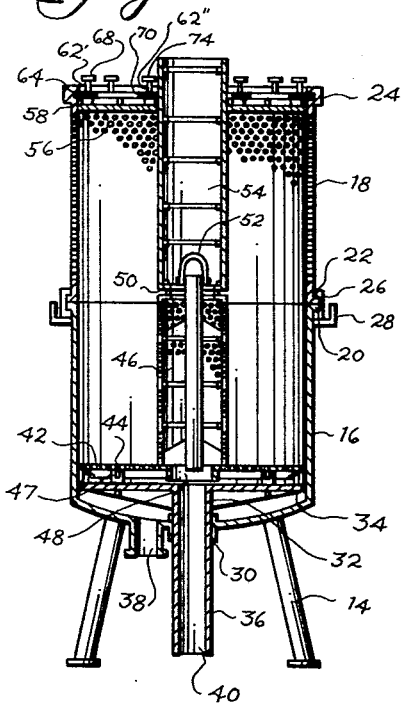
Fig. 6
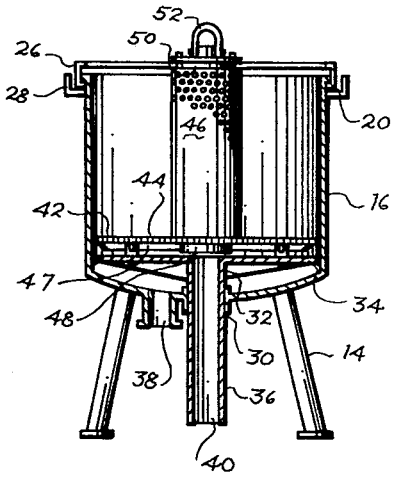
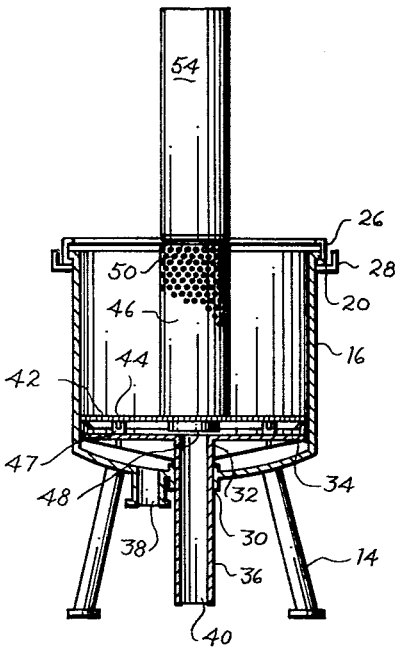
Fig. 7
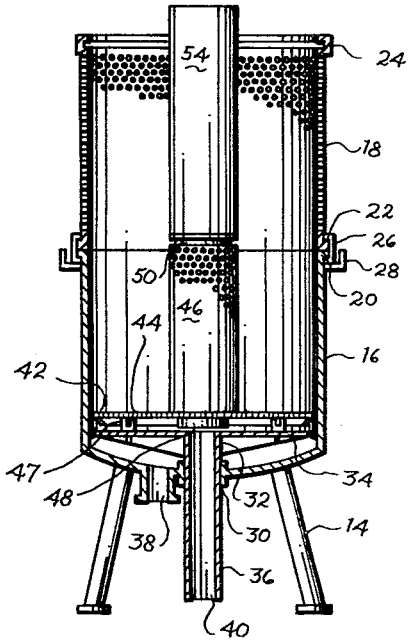
Fig. 8

Fig. 13
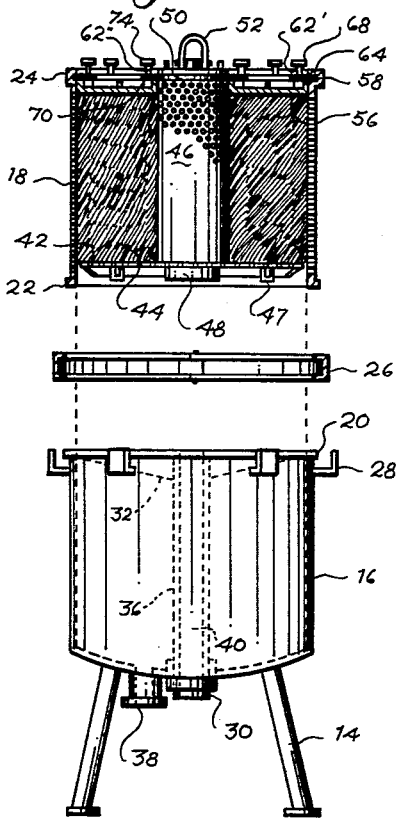
Fig. 14
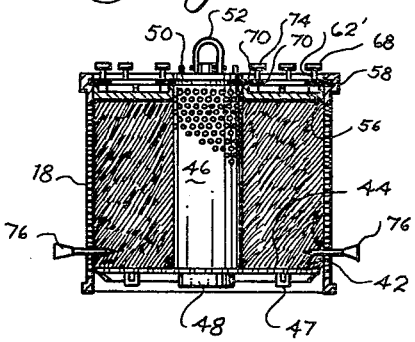
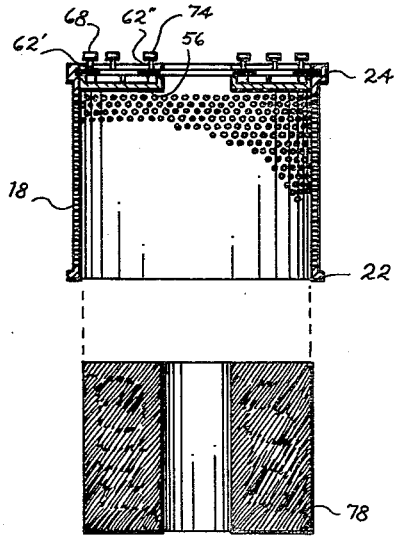
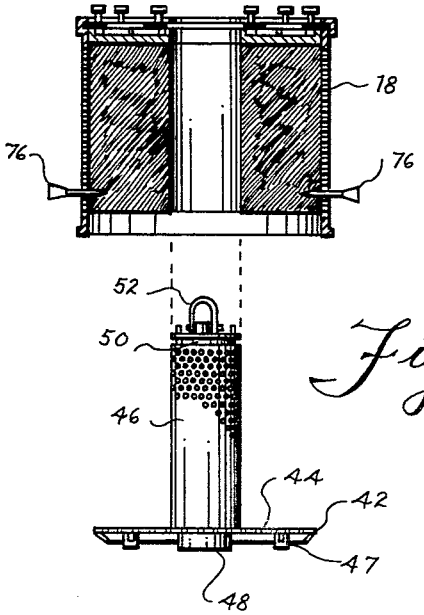
Fig. 15
Fig. 16

APPARATUS AND METHOD FOR PROCESSING RAW FIBER STOCK

BACKGROUND OF THE INVENTION

The present invention relates to apparatus and methods for preparing raw textile fiber stock for wet processing and particularly to such apparatus and methods for compressing fiber stock into a suitable "cake" in a perforated dyeing cylinder for dyeing or other conventional wet processing operations.

The dyeing or other wet processing of raw staple fiber stock may conventionally be accomplished in one of two manners. First, a predetermined quantity of fiber stock may simply be wetted and loaded into a suitable kier or other dyeing vessel following which the dyeing vessel is closed and operated in ordinary manner to circulate dyeing liquor downwardly through the fiber stock. This dyeing procedure has not proved wholly satisfactory because of a tendency of the fiber stock to pack downwardly in the vessel and to form an impenetrable plug in the bottom thereof. Further, considerable machine down time is experienced with this procedure in the loading and unloading of the vessel. In recent years, an alternative procedure for the dyeing of raw fiber stock in a conventional radial flow dyeing machine has become more popular. According to this procedure, raw fiber stock is initially loaded into the dyeing cylinder or basket of such a radial flow machine and then compressed in the basket into a "cake", following which the dyeing cylinder is placed in the machine for ordinary dyeing operation thereof. This procedure provides distinct advantages in that such radial flow machines are less costly and are generally capable of handling greater loads than comparable kier-type machines and, since the fiber compression process can be accomplished independently, machine down time is required only for the exchange of preloaded dyeing cylinders. However, a principal disadvantage also exists with this procedure in that the conventional equipment available for performing the fiber cake formation are relatively large and complicated hydraulic presses, such as that manufactured by Autsburger Textilmaschinenfabrik GMBH, Augsberg, West Germany, under the model designation Autefa and this equipment is costly, occupies considerable space, and presents substantial maintenance requirements and problems in the hot and humid environment typical of textile dyehouses.

In contrast, the present invention provides an easily-operated, inexpensive, space-saving and low maintenance apparatus and method for appropriately compressing raw fiber stock into suitable fiber cakes in dyeing cylinders using pressurized water to generate the required compressive forces.

SUMMARY OF THE INVENTION

Briefly described, the apparatus of the present invention includes a hollow container for receiving and containing fiber stock. The container has an imperforate section and a perforate section detachably joined together. The imperforate section has an open end at the juncture with the perforate section and has a closed opposite end. The perforate section has an open end at the juncture with the imperforate section to define a common interior for receipt and compression therein of raw fiber stock. The perforate section further has an opening remote from the imperforate section for introduction therethrough of raw fiber stock into the container interior. A removable end cover is mountable on the perforate section in covering relation over the opening. Piston means is reciprocably movable in the imperforate section toward and away from the perforate section between a fiber-loading position withdrawn from the perforate section and a fiber compressing position at the perforate section for compressing the fiber stock in the housing into the perforate section. Closure means is attachable across the open end of the perforate section at the imperforate section upon completion of compression of the fiber by the piston means into the perforate section. The closure means is attachable to the perforate section independently of the imperforate section so that the perforate section with compressed fiber stock therewithin and with the end cover and closure means attached thereto may be separated as a unit from the imperforate section for use as a fiber-containing basket in a subsequent textile wet processing operation.

Preferably, the imperforate section includes means for admitting and discharging fluid behind the piston means opposite the perforate section for actuating the reciprocal movement of the piston means, and this fluid admitting and discharging means is adaptable for connection with a source of water under pressure.

Also preferably, the closure means is movable with the piston means from the withdrawn fiber-loading position to the fiber compressing position at which the closure means is attachable to the perforate section. In the preferred embodiment, the closure means includes reinforcing ribs projecting toward the piston means to space portions of the closure means from the piston means for flow through the spacings of some of the liquid exiting the perforate section.

Also preferably, a central core element extends through the perforate section and this core element itself is perforate. In the preferred embodiment, the core element is secured to and movable with the closure means and extends through and is removably latched to the end cover when the closure means and central core element are in the fiber compressing position. Similarly, the end cover is latched to the perforate section, thereby attaching the closure means, core element and end cover to the perforate section to form the aforementioned basket.

Also, in the preferred embodiment the core element extends less than the full extent of the interior of the container when the core, closure means and piston means are in the withdrawn position, and an extension element is removably mounted on the core element to extend from the core element through the container interior to the exterior thereof. This extension element is disposed exteriorly of the perforate section when the piston means, closure means and core element are disposed in the fiber compressing position in which the extension element is removable from the core element.

Further, in the preferred embodiment a drain conduit is provided through the piston means and imperforate section to the exterior for draining of fluid exiting through the perforate section, with the drain conduit being secured to and movable with the piston means.

To facilitate removal of the compressed fiber stock after subsequent treatment, the present invention provides engaging and retaining means insertable in the perforate section for engaging and retaining compressed fiber stock in the perforate section upon removal of the movable closure means, with the insertable means being subsequently removable to permit removal of the compressed fiber stock. In the preferred embodiment, this insertable means comprises spikes insertable through the perforations of the perforate section into the compressed fiber stock.

For preferred operation, the perforate section is disposed vertically above the imperforate section with the piston means movable vertically from a lower withdrawn position to an upper fiber compressing position and with the fluid admitting and discharging means disposed below the lower withdrawn position of the piston means. In this arrangement the aforementioned drain conduit extends vertically downward through the imperforate section to the exterior therebelow.

In the method of the present invention, the two sections are first joined together and then the common interior is loaded with wet fiber stock through the opening in the perforate section remote from the imperforate section. The opening is then closed and the piston means moved from the withdrawn position toward the perforate section to compress the raw fiber stock into the perforate section while expelling liquid therefrom through the perforations of the perforate section. The closure means is then attached across the open end of the perforate section at the imperforate section to retain the compressed fiber stock in the perforate section. The perforate section is then removed from the imperforate section with the closure means remaining attached to the perforate section. Preferably, movement of the piston means is accomplished by introducing liquid under pressure behind the piston means in the imperforate section remote from the perforate section, and liquid is introduced through the aforesaid opening in the perforate section during loading of the fiber stock to wet the fiber stock.

In the preferred embodiment of the method, the closure means is placed on the piston means during assembly of the imperforate and perforate sections prior to loading of the fiber stock and the closure means moves with the piston means during compression of the fiber stock.

Further, preferably the central core element is disposed in the common interior prior to loading of the fiber stock, and in the preferred embodiment the central core element is secured to and movable with the closure means so that when the components have been moved to the fiber compressing position the core element can be attached in the end cover of the perforate section, thereby attaching the core element and closure plate to the perforate section. Also preferably, the extension element is placed on the core element prior to fiber loading and is removed after the core element has been moved to extend through the perforate section.

After further processing of the compressed fiber stock while in the perforate section, the fiber stock is withdrawn by first retaining the fiber stock in the perforate section while removing the closure means and then releasing the stock for removal. This is accomplished in the preferred embodiment by inserting retaining means through perforations in the perforate section prior to removal of the closure means and then withdrawing the retaining means after the closure means has been removed to release the fiber stock for withdrawal.

BRIEF DESCRIPTION OF THE DRAWINGS

FIG. 1 is a side elevational view of the apparatus of the present invention;

FIG. 2 is an exploded side elevational view thereof;

FIG. 3 is a top plan view thereof;

FIG. 3*a* is an enlargement, partially in section, of the latching means included in FIG. 3;

FIG. 4 is a top plan view of the attachment arrangement thereof;

FIG. 5 is a vertical sectional view thereof taken along lines 5—5 of FIG. 3; and FIGS. 6–16 are further vertical sectional views thereof sequentially showing the apparatus in various stages of assembly and operation in the performance of the present method.

DESCRIPTION OF THE PREFERRED EMBODIMENT

Figure 9:
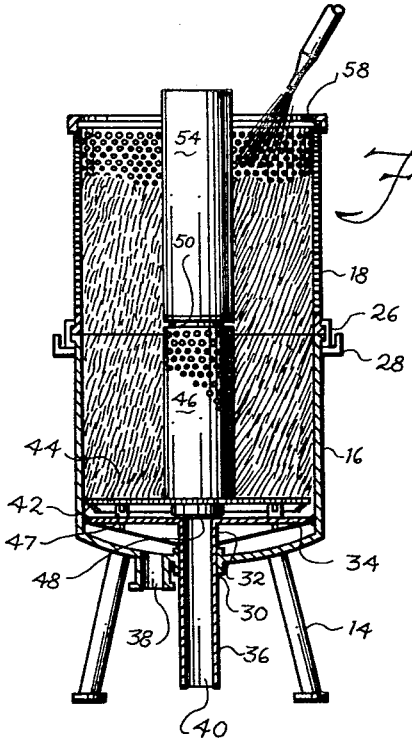

Referring now to the accompanying drawings and initially to FIGS. 1–5, the apparatus of the present invention is indicated generally at 10 and includes a hollow cylindrical container 12 supported in vertically upright fashion on several legs 14. The container 12 includes two cylindrical sections 16,18 of substantially the same diameter separably joined in stacked relation, the lower section 16 being of imperforate construction enclosed at its lowermost end and open at its uppermost end and the upper section 18 open at its upper and lower ends and perforated about substantially its entire surface area. The lower imperforate section 16 is provided with an outwardly-extending annular lip 20 about its upper edge and the upper perforate section 18 is provided with similar lips 22,24 about its upper and lower edges, respectively. An annular locking band 26 of the conventional type having a "quick-release" tightening connection between its ends is provided for engaging the lower lip 22 of the perforate section 18 and the upper lip 20 of the imperforate section 16 for securing assembly of the sections 16,18 in their stacked relationship. Spaced angle brackets 28 welded about the exterior periphery of the imperforate section 16 adjacent its lip 20 provide support for the band 26 when released.

Figure 12:
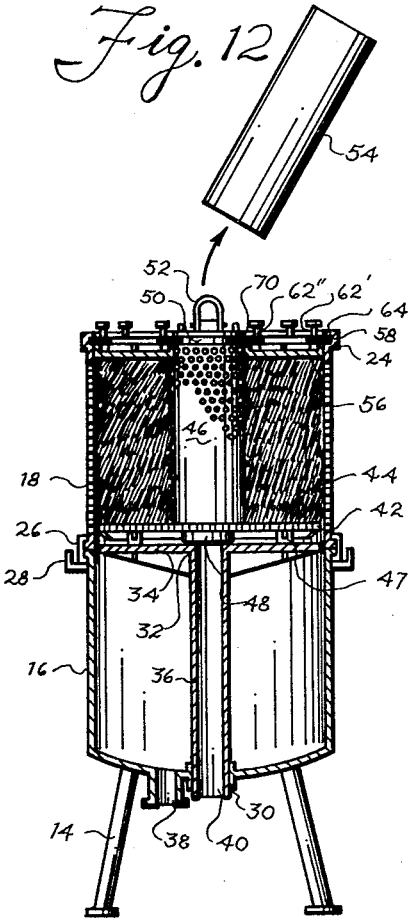

Piston means 32 is provided having a circular disk 34 of a diameter slightly smaller than the inner diameter of the section 16, and a cylindrical guide rod 36 extends centrally from the underside of the disk 34, the piston 32 being disposed reciprocably in the section 16 with the guide rod 36 extending slidably through a circular opening 30 located centrally in the bottom wall of the imperforate section in sealing engagement therewith. A gasket 35 at the peripheral edge of the disk 34 is in sealing contact with the inner wall surface of the section 16. In this manner, the piston 32 is adapted for movement between a position withdrawn within the imperforate section 16 (FIG. 5) and a position at the perforate section 18 (FIG. 12). Another opening 38 is formed in the bottom wall of the imperforate section 16 for connection with a suitable source of fluid under pressure, preferably a conventional water pump (not shown), for admitting the pressurized fluid to the section 16 behind the piston 32 opposite the perforate section 16 for hydraulically actuating its reciprocal movement therein.

For purposes which will hereinafter be more fully described, the piston 32 is provided with a central drain conduit 40 through its disk 34 and its guide rod 36 providing fluid communication between the interior of the container 12 above the disk 34 and the exterior of the container 12. Closure means 42 is disposed within the container 12 resting on the upwardly-facing surface of the disk 34 for movement with the piston 32, the closure means 42 including a circular disk or flange 44 of a slightly smaller diameter than the sections 16,18. A cylindrical central core element 46 is affixed upstandingly to the flange 44. The flange 44 is imperforate and is formed with ribs 47 projecting toward the piston disk 34 to maintain the flange 44 at a slight spacing from the piston disk 34 for open fluid communication to the drain conduit 40 from the container interior. Additionally, the flange 44 has a central opening 48 and the core element 46 is perforated and hollow to provide fluid communication therethrough to the conduit 40. The core element 46 is closed at its upper end and is provided with an annular groove 50 in its periphery adjacent thereto and has an upwardly extending hook 52 in its top surface.

The core element 46 extends less than the full extent of the container interior when in the withdrawn position, and an imperforate cylindrical core extension element 54 is adapted to be stacked atop the core element 46 such that, when the piston 32 is in its withdrawn position, the two core members 46,65 extend longitudinally centrally through the full height of the container 12 and slightly thereabove.

An end cover 56 is provided for attachment to the lip 24 in the upper edge of the perforate section 18 to close the opening thereat. As best seen in FIG. 5, the upper lip 24 of the perforate section 18 defines an inwardly-opening annular groove 58, and the end cover 56 is of a diameter approximately the same as or only slightly smaller than the inner diameter of the perforate section 18 and has a central opening 60 of a diameter approximately the same as or only slightly greater than the diameter of the core members 46,54. A plurality of latching screws 62',62" are affixed to the upper surface of the end cover 56 at spacings about the outer edge thereof and about the central opening 60 thereof. As best seen in FIGS. 3 and 3*a*, the outer circle of screws 62' includes twelve screws arranged in four groups of three screws each and the inner circle of screws 62" includes eight screws arranged in four corresponding groups of two screws each. Four arcuate latching plates 64 each having thee longitudinal guide slots 66 formed in parallel relation therein at spacings corresponding to the spacings of the screws 62' of each group of three in the outer circle are disposed on the cover 56 with their respective slots 66 slidably receiving the screws 62' of a respective group and are secured in such disposition by manual tightening engagement of the heads 68 of the screws 62'. Similarly, four arcuate latching plates 70 each having two spaced parallel guide slots 72 are disposed on the end cover 56 with their respective slots 72 slidably receiving the screws 62" of a respective group of the inner screws 62" and are secured by manual tightening engagement of heads 74 of the screws 62". In this manner, each plate 64 may be moved slidably in a direction radially of the cover 56 selectively to project radially outwardly beyond the peripheral edge of the end cover 56 or to be disposed inwardly thereof and, similarly, each latching plate 70 may be slidably moved radially to project inwardly of the central cover groove 60 or to be disposed outwardly thereof. Thus, the end cover 56 may be attached to the perforate section 18 by disposing the end cover 56 in the opening of the perforate section 18 and manipulating the plates 64 to extend radially outwardly of the outer edge of the cover 56 and into the groove 58 of the lip 24, and then tightening the screws 62'. Similarly, the end cover 56 may be attached to the upper end of the perforate core element 46 at the appropriate point in its reciprocal movement with the piston 32 at which the upper end of the perforate core element 46 projects through the cover opening 60 with the extension core element 54 having moved through the end cover opening 60 by first removing the extension core element 54 and then manipulating the latching plates 70 to extend radially inwardly of the openings 60 into the groove 50 in the upper end of the perforate core element 46 and tightening the screws 62".

The operation of the present apparatus and performance of the present method will thus be understood with reference to FIGS. 6–16. In FIGS. 6–8, there is illustrated the initial partial assembly of the apparatus to ready it for loading thereinto of raw fiber stock, it being necessary to initially position the closure means 40 and core element 46 secured thereto in the imperforate section 16 in a central disposition resting on the piston 32 (FIG. 6). The extension core element 54 is then mounted on the perforate core element 46, and the perforate section 18 is stacked on and joined to the imperforate section 16 using the locking band 26. In this stage of assembly and prior to attachment of the end cover 56, raw fiber stock is loaded by any conventional means into the annular common interior between the core members 46,54 and the inner walls of the container 12 while at the same time the stock is thoroughly wetted by spraying thereonto a source of water (FIG. 9) heated to a temperature at or near boiling or to some other selected temperature.

Figure 10:
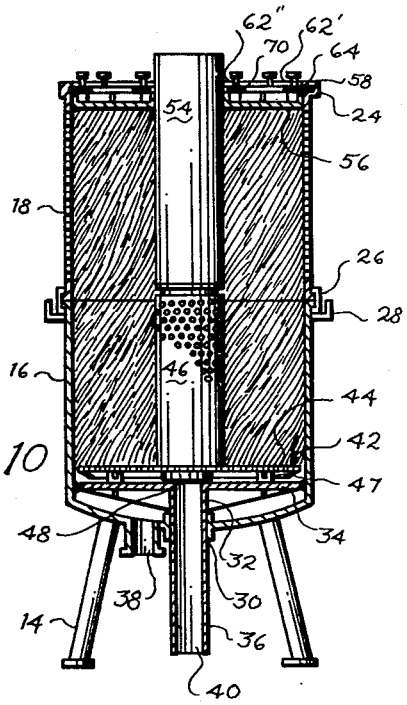
Figure 11:
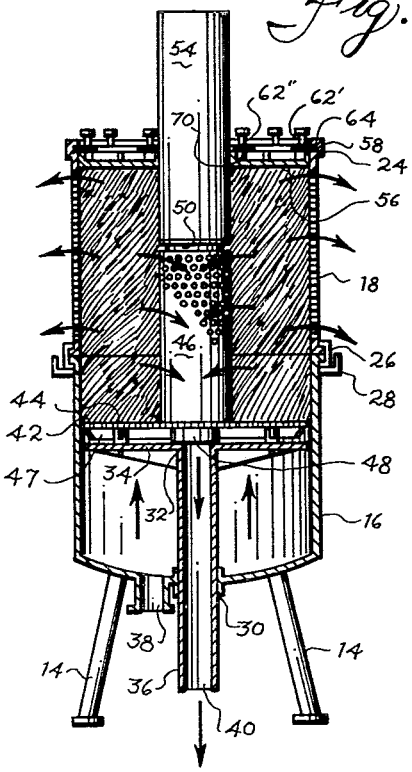

Once the desired quantity of fiber stock has been loaded, the end cover 56 is attached to the upper lip 24 of the perforate section 18 as above-described (FIG. 10). An appropriate supply of water under pressure such as the aforementioned conventional water pump is then connected to the opening 38 and is operated to direct water into the imperforate section 16 below the piston 32 to hydraulically drive it and the closure means 42 upwardly (FIG. 11). As will be understood, the movement of the piston 32 is effective in this manner to compress the loaded fiber stock into the perforate section 18 while at the same time expelling therefrom a substantial amount of the air and water content of the fiber stock which exits through the perforations of the perforate section 18 and core element 46 into the drain conduit 40 of the piston 32, all as indicated by the directional arrows in FIG. 11. The piston 32 is operated in this manner to move upwardly the full height of the imperforate section 16 at which disposition the core extension element 54 extends substantially entirely outwardly through the cover opening 60 and the flange 44 is disposed at the lower edge of the perforate section 18 substantially enclosing it (FIG. 12). In such disposition, the imperforate core extension element 54 is removed from the core element 46 and, the groove 50 at the upper end of the core element 46 being thusly disposed adjacent the cover opening 60, the arcuate latching plates 70 are manipulated to attach the cover 56 to the core member 46 as above-described.

As will be understood, following such affixation of the cover 56 to the core element 46, the perforate section 18, the cover 56 and the closure means 42 essentially form an enclosed unit containing the compressed fiber stock, which unit, being perforated except at the cover 56 and closure plate 44, is readily adapted for use as a fiber-containing basket in a radial-flow type dyeing machine or in another similar textile wet processing operation. Accordingly, the locking band 26 is next released to permit the separation of the unit of the perforate section 18, the cover 56 and the closure means 42 from the remainder of the apparatus so that it may be lifted by the hook 52 and transported to another location for dyeing, drying or other processing.

Following the desired wet processing operation and any other desired processing of the stock which would be best facilitated in the assembled unit form, the processed fiber stock is removed from the assembled unit by initially inserting a plurality of spikes 76 or other suitable engaging and retaining means through the perforations of the perforate section 18 into the fiber stock adjacent the closure means 42 to engage and retain the stock therein (FIG. 14), then detaching and removing the closure means 42 from assembly with the cover 56, the spikes 76 retaining the fiber stock in the section 18 during this operation (FIG. 15). The spikes 76 are then removed to release the stock and permit it to drop out of the section 18 in the form of a "cake" 78, whereupon the stock may be further processed in conventional manner.

The advantages of the present method and apparatus will thus be understood by those skilled in the art. Structurally, the present apparatus is of a relatively simple construction which is inexpensive, easy and efficient to operate, and will occupy little space, all to be contrasted with the conventional hydraulic presses presently being used. In further contrast to conventional equipment, the present apparatus combines in one device the necessary apparatus for both loading fiber stock into a dyeing cylinder or basket and the proper compressing of the fiber stock once loaded. Functionally, the present apparatus is equally effective with conventional devices for appropriately compressing the raw fiber stock into the cake-like form desired for dyeing and wet processing at a substantially lower operating cost by eliminating the need for complicated hydraulic equipment and instead employing easily and economically produced water pressure. Furthermore, the mechanical simplicity of the present apparatus substantially eliminates the maintenance problems commonly attendant to conventional hydraulic equipment.

The present invention has been described in detail above for purposes of illustration only and is not intended to be limited by this description or otherwise to exclude any variation or equivalent arrangement that would be apparent from, or reasonably suggested by the foregoing disclosure to the skill of the art. For example, other more simplified latching means could be utilized rather than the slotted plates, grooves and screws disclosed herein.

We claim:

1. An apparatus for compressing raw fiber stock in preparation for subsequent wet processing comprising a hollow container for receiving and containing fiber stock, said container having an imperforate section and a perforate section detachably joined together, said imperforate section having an open end at the juncture with said perforate section and having a closed opposite end, said perforate section having an open end at the juncture with said imperforate section to define a common interior for receipt and compression therein of raw fiber stock, said perforate section having an opening remote from said imperforate section for introduction therethrough of raw fiber stock into said container interior, a removable end cover mountable on said perforate section in covering relation over said opening, piston means reciprocably movable in said imperforate section toward and away from said perforate section between a fiber-loading position withdrawn within said perforate section and a fiber compressing position at said perforate section for compressing the fiber stock in said housing into said perforate section, closure means attachable across the open end of said perforate section at said imperforate section upon completion of compression of fiber by said piston means into said perforate section, said closure means being attachable to said perforate section independently of said imperforate section, whereby said perforate section with compressed fiber stock therewithin and with said end cover and closure means attached thereto may be separated as a unit from said imperforate section for use as a fiber-containing basket in a subsequent textile wet processing operation.

2. An apparatus for compressing raw fiber stock according to claim 1 and characterized further in that said imperforate section includes means for admitting thereinto and discharging therefrom fluid behind said piston means opposite said perforate section for actuating said reciprocal movement of said piston means.

3. An apparatus for compressing raw fiber stock according to claim 2 and characterized further in that said fluid admitting and discharging means is adapted for connection with a source of water under pressure.

4. An apparatus for compressing raw fiber stock according to claim 2 or 3 and characterized further in that said perforate section is disposed vertically above said imperforate section with said piston means being movable vertically from a lower withdrawn position to an upper fiber compressing position, and said fluid admitting and discharging means being disposed below the lower withdrawn position of said piston means.

5. An apparatus for compressing raw fiber stock according to claim 1 and characterized further in that said closure means is movable with said piston means from said withdrawn fiber-loading position to said fiber compressing position at which said closure means is attachable to said perforate section.

6. An apparatus for compressing raw fiber stock according to claim 1 and characterized further in that said movable closure means includes ribs projecting toward said piston means to provide spacings between portions of said closure means amd said piston means for discharge through said spacings of liquid exiting said perforate section.

7. An apparatus for compressing raw fiber stock according to claim 1 and characterized further by a central core element extending through said perforate section, said core element being perforate.

8. An apparatus for compressing raw fiber stock according to claim 7 and characterized further in that said core element is removable from said perforate section.

9. An apparatus for compressing raw fiber stock according to claim 8 and characterized further in that said core element is secured to and movable with said closure means.

10. An apparatus for compressing raw fiber stock according to claim 6, 7, 8 or 9 and characterized further by a drain conduit extending through said piston means and imperforate section to the exterior of said imperforate section for draining of fluid exiting said perforate section.

11. An apparatus for compressing raw fiber stock according to claim 10 and characterized further in that said drain conduit is secured to and movable with said piston means.

12. An apparatus for compressing raw fiber stock according to claim 11 and characterized further in that said perforate section is disposed vertically above said imperforate section with said piston means being movable vertically from a lower withdrawn position to an upper fiber compressing position, said imperforate section includes means for admitting thereinto and discharging therefrom fluid below the lower withdrawn position of said piston means for actuating said reciprocal movement of said piston means, and said drain conduit extends vertically downward through said imperforate section to the exterior therebelow.

13. An apparatus for compressing raw fiber stock according to claim 9 and characterized further in that said core element extends less than the full extent of the interior of said container when said piston means is in said withdrawn position, and an extension element is removably mounted on said core element to extend from the core element through said container interior to the exterior thereof, said extension element being disposed exteriorly of said perforate section when said piston means and core element are disposed in said fiber compressing position in which position said extension element is removable from said core element.

14. An apparatus for compressing raw fiber stock according to claim 7, 8 or 9 and characterized further by movable latching means for attaching said central core element to said end cover.

15. An apparatus for compressing raw fiber stock according to claim 14 and characterized further by additional movable latching means for securing said removable end cover to said perforate section.

16. An apparatus for compressing raw fiber stock according to claim 1 and characterized further by means insertable in said perforate section for engaging and retaining in said perforate section compressed fiber stock upon removal of said closure means, said insertable means being removable to permit removal of the compressed fiber stock from said perforate section.

17. An apparatus for compressing raw fiber stock according to claim 16 and characterized further in that said insertable means comprises spike means insertable through the perforations of said perforate section into the compressed fiber stock therein.

18. An apparatus for compressing raw fiber stock according to claim 1 and characterized further by movable latching means for securing said end cover to said perforate section.

19. A method of compressing raw fiber stock in preparation for subsequent wet processing thereof, said method using a hollow container having an imperforate section and a perforate section detachably joined to form a common interior and with piston means reciprocably movable in the imperforate section toward and away from the perforate section, said method comprising joining said imperforate section and perforate section together, loading wet raw fiber stock into the common interior of the hollow container through an opening in the perforate section remote from said imperforate section, closing said opening, moving said piston means in said imperforate section toward said perforate section to compress the raw fiber stock into the perforate section while expelling liquid therefrom through the perforations of the perforate section, attaching closure means across the open end of the perforate section at the imperforate section to retain said compressed fiber stock in said perforate section, and removing said perforate section from said imperforate section with said closure means remaining attached to said perforate section for subsequent wet treatment of the compressed fiber stock while in said perforate section.

20. A method of compressing raw fiber stock according to claim 19 and characterized further by introducing liquid through said opening in said perforate section during loading of said fiber stock into said common interior to wet the fiber stock therein.

21. A method of compressing raw fiber stock according to claim 19 and characterized further in that said moving of said piston means is accomplished by introducing liquid under pressure behind said piston means in said imperforate section remote from said perforate section.

22. A method of compressing raw fiber stock according to claim 21 and characterized further by placing said closure means on said piston means during assembly of said imperforate and perforate sections prior to loading of said fiber stock into said common interior, and moving said closure means with said piston means during compressing of said fiber stock to position said closure means for attachment to said perforate section.

23. A method of compressing raw fiber stock according to claim 19, 20, 21 or 22 and characterized further by disposing a central core element in said common interior during assembly of said imperforate and perforate sections prior to loading of fiber stock thereinto, and attaching said core element in said perforate section subsequent to compression of the fiber stock into said perforate section.

24. A method of compressing raw fiber stock according to claim 23 and characterized further in that in closing said opening an end cover is mounted over said opening, and said attaching of said core element to said perforate section is accomplished by attaching said core element to said end cover.

25. A method of compressing raw fiber stock according to claim 23 and characterized further in that said core element is secured to and movable with said closure means and said attaching of said closure means to said perforate section is accomplished by said attachment of said core element to said perforate section.

26. A method of compressing raw fiber stock according to claim 25 and characterized further in that in closing said opening an end cover is mounted over said opening, and said attaching of said core element to said perforate section is accomplished by attaching said core element to said end cover.

27. A method of compressing raw fiber stock according to claim 23 and characterized further in that in its initially assembled position said core element extends less than the full extent of the interior of the container and the method includes removably mounting an extension element on the core element to extend from the core element through the container interior to the exterior thereof and removing said extension element subsequent to said compressing of the fiber stock into said perforate section.

28. A method of compressing raw fiber stock according to claim 23 and characterized further by removing said closure means from said perforate section after the fiber stock has been further processed in said perforate section, and withdrawing said processed fiber stock from said perforate section.

29. A method of compressing raw fiber stock according to claim 28 and characterized further by inserting retaining means through perforations in said perforate section prior to removal of said closure means and core element to retain said fiber stock in said perforate section until after said closure means and core element have been removed.

30. A method of compressing raw fiber stock according to claim 19, 20 or 21 and characterized further in that in said joining of said imperforate section and perforate section the sections are joined with the perforate section disposed vertically above the imperforate section and the piston means is disposed in a lower withdrawin position for upward vertical movement during said compressing of the fiber stock into said perforate section.

31. A method of compressing raw fiber stock according to claim 19 and characterized further by removing said closure means from said perforate section after the fiber stock has been further processed in said perforate section, and withdrawing said processed fiber stock from said perforate section.

32. A method of compressing raw fiber stock according to claim 30 and characterized further by inserting retaining means through perforations in said perforate section prior to removal of said closure means to retain said fiber stock in said perforate section until after said closure means has been removed, and then removing said retaining means to allow withdrawal of said fiber stock from said perforate section.

* * * * *